US007100917B2

(12) United States Patent
Wang

(10) Patent No.: US 7,100,917 B2
(45) Date of Patent: Sep. 5, 2006

(54) MAGIC CUBE

(76) Inventor: Ching-Te Wang, 69, Wan Qiu, Wan Qiu Cun, Nan Xi Hsiang, Tainan Hsien (TW)

( * ) Notice: Subject to any disclaimer, the term of this patent is extended or adjusted under 35 U.S.C. 154(b) by 23 days.

(21) Appl. No.: 11/042,461

(22) Filed: Jan. 25, 2005

(65) Prior Publication Data

US 2006/0163810 A1 Jul. 27, 2006

(51) Int. Cl.
*A63F 9/08* (2006.01)

(52) U.S. Cl. ..... 273/153 S

(58) Field of Classification Search ..... 273/153 S, 273/157 R, 153 R, 146
See application file for complete search history.

(56) References Cited

U.S. PATENT DOCUMENTS 3,565,442 A * 2/1971 Klein ..... 273/157 R
4,409,750 A * 10/1983 Silbermintz ..... 273/153 S
4,421,311 A * 12/1983 Sebesteny ..... 273/153 S
4,428,581 A * 1/1984 Nagorny ..... 273/153 S
4,437,667 A * 3/1984 Miller ..... 273/153 S
6,626,431 B1 * 9/2003 Possidento ..... 273/153 S

OTHER PUBLICATIONS

Slocum, Jerry et al., "Puzzles: Old & New: How to Make and Solve Them", 1986, Plenary Publications International, pp. 138-139.*

* cited by examiner

*Primary Examiner*—Steven Wong
(74) *Attorney, Agent, or Firm*—Alan D. Kamrath; Nikolai & Mersereau, P.A.

(57) ABSTRACT

A magic cube includes a larger cubic block formed by a plurality of smaller cubic blocks. The larger cubic block has six larger faces each having nine smaller faces, wherein a central one of the nine smaller faces is indicated by a circular pointed marking ranged from 1 (one) to 6 (six) point, and the other ones of the nine smaller faces is indicated by an Arabic numeral ranged from 1 (one) to 48 (forty-eight). Thus, all of the Arabic numerals are arranged in an irregular manner, and all of the circular pointed markings are located at the central position of each of the six relatively larger faces.

6 Claims, 5 Drawing Sheets

MAGIC CUBE

BACKGROUND OF THE INVENTION

1. Field of the Invention

The present invention relates to a magic cube, and more particularly to a magic cube having an enhanced playing amusement effect.

2. Description of the Related Art

A conventional magic cube in accordance with the prior art shown in FIG. 5 comprises a relatively larger cubic block 2 formed by a plurality of relatively smaller cubic blocks 21 to form a cubic body. The relatively larger cubic block 2 has six faces having different colors. The relatively larger cubic block 2 can be rotated and swiveled longitudinally and transversely in a random manner to change the relative position between the relatively smaller cubic blocks 21 and to change the colors of the relatively larger cubic block 2, thereby providing an amusement effect. However, the variation of the relative position between the relatively smaller cubic blocks 21 and the colors of the relatively larger cubic block 2 is simple and tedious, thereby limiting the amusement effect of the conventional magic cube.

SUMMARY OF THE INVENTION

In accordance with the present invention, there is provided a magic cube, comprising a relatively larger cubic block formed by a plurality of relatively smaller cubic blocks to form a cubic body, wherein: the relatively larger cubic block has six relatively larger faces each having nine relatively smaller faces; a central one of the nine relatively smaller faces of the six relatively larger faces is indicated by a circular pointed marking ranged from 1 (one) to 6 (six) point; and the other ones of the nine relatively smaller faces of the six relatively larger faces is indicated by an Arabic numeral ranged from 1 (one) to 48 (forty-eight).

The primary objective of the present invention is to provide a magic cube having an enhanced playing amusement effect.

Another objective of the present invention is to provide a magic cube, wherein the relatively larger cubic block of the magic cube has six circular pointed markings corresponding to the six circular pointed markings of the dice and has forty-eight Arabic numerals matching the respective circular pointed markings, so that the players can calculate all of the Arabic numerals located at the same face of the circular pointed marking to determine the winner, thereby enhancing the amusement effect of the magic cube.

A further objective of the present invention is to provide a magic cube, wherein the playing regulation of the magic cube is designed by a computer program and executed by the on-line computer internet, so that the players can play the game of the magic cube instantly, thereby providing an interesting effect to the on-line players.

Further benefits and advantages of the present invention will become apparent after a careful reading of the detailed description with appropriate reference to the accompanying drawings.

DETAILED DESCRIPTION OF THE INVENTION

Figure 1:
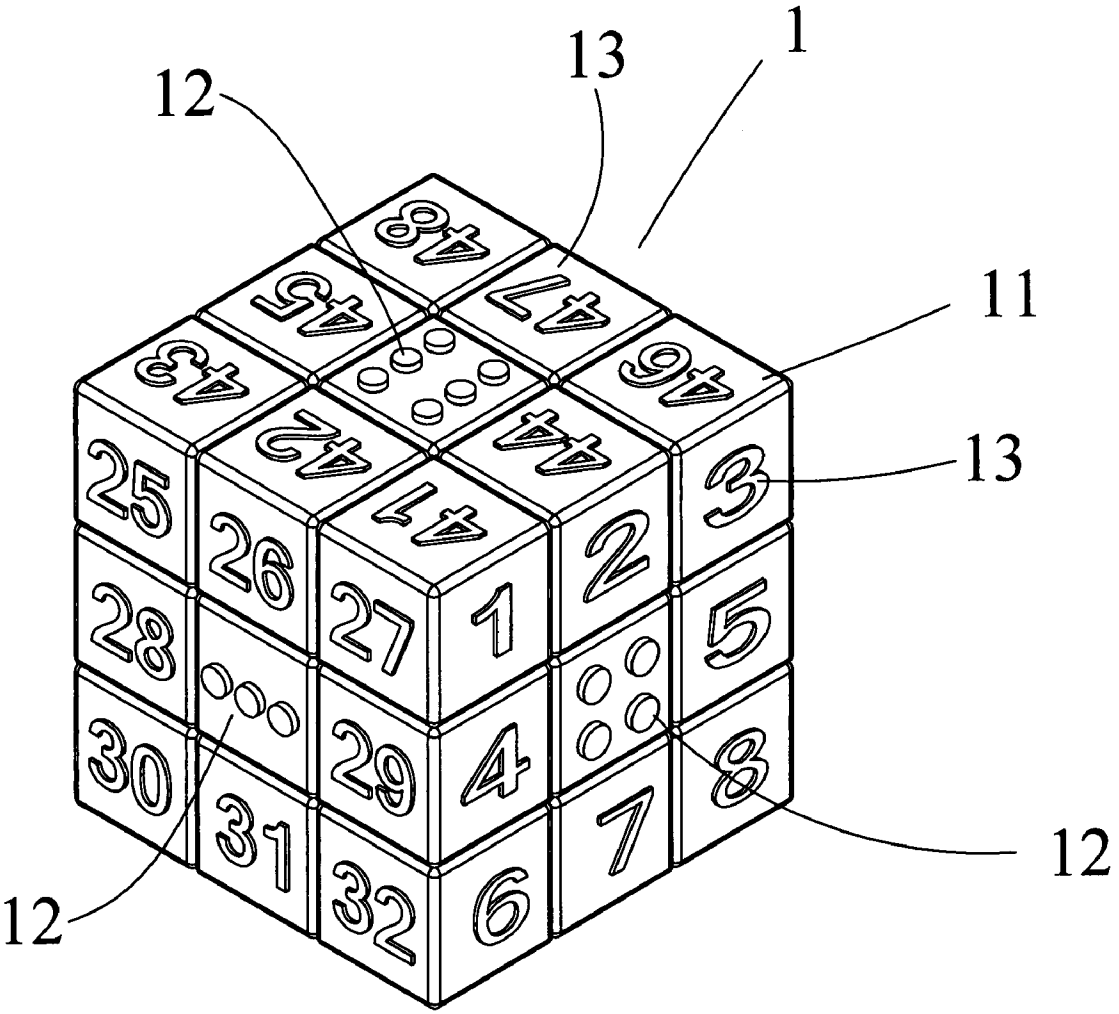
FIG. 1 is a perspective view of a magic cube in accordance with the preferred embodiment of the present invention.

Referring to the drawings and initially to FIG. 1, a magic cube in accordance with the preferred embodiment of the present invention comprises a relatively larger cubic block 1 formed by a plurality of relatively smaller cubic blocks 11 to form a cubic body. The relatively larger cubic block 1 has six relatively larger faces each having nine relatively smaller faces, wherein a central one of the nine relatively smaller faces of the six relatively larger faces is indicated, by a circular pointed marking 12 ranged from 1 (one) to 6 (six) point, and the other ones of the nine relatively smaller faces of the six relatively larger faces is indicated by an Arabic numeral 13 ranged from 1 (one) to 48 (forty-eight). The relatively larger cubic block 1 can be rotated and swiveled longitudinally and transversely in a random manner to change the relative position between the relatively smaller cubic blocks 11. At this time, all of the Arabic numerals 13 of the relatively larger cubic block 1 are arranged in an irregular manner, and all of the circular pointed markings 12 of the relatively larger cubic block 1 are located at the central position of each of the six relatively larger faces.

Figure 2:
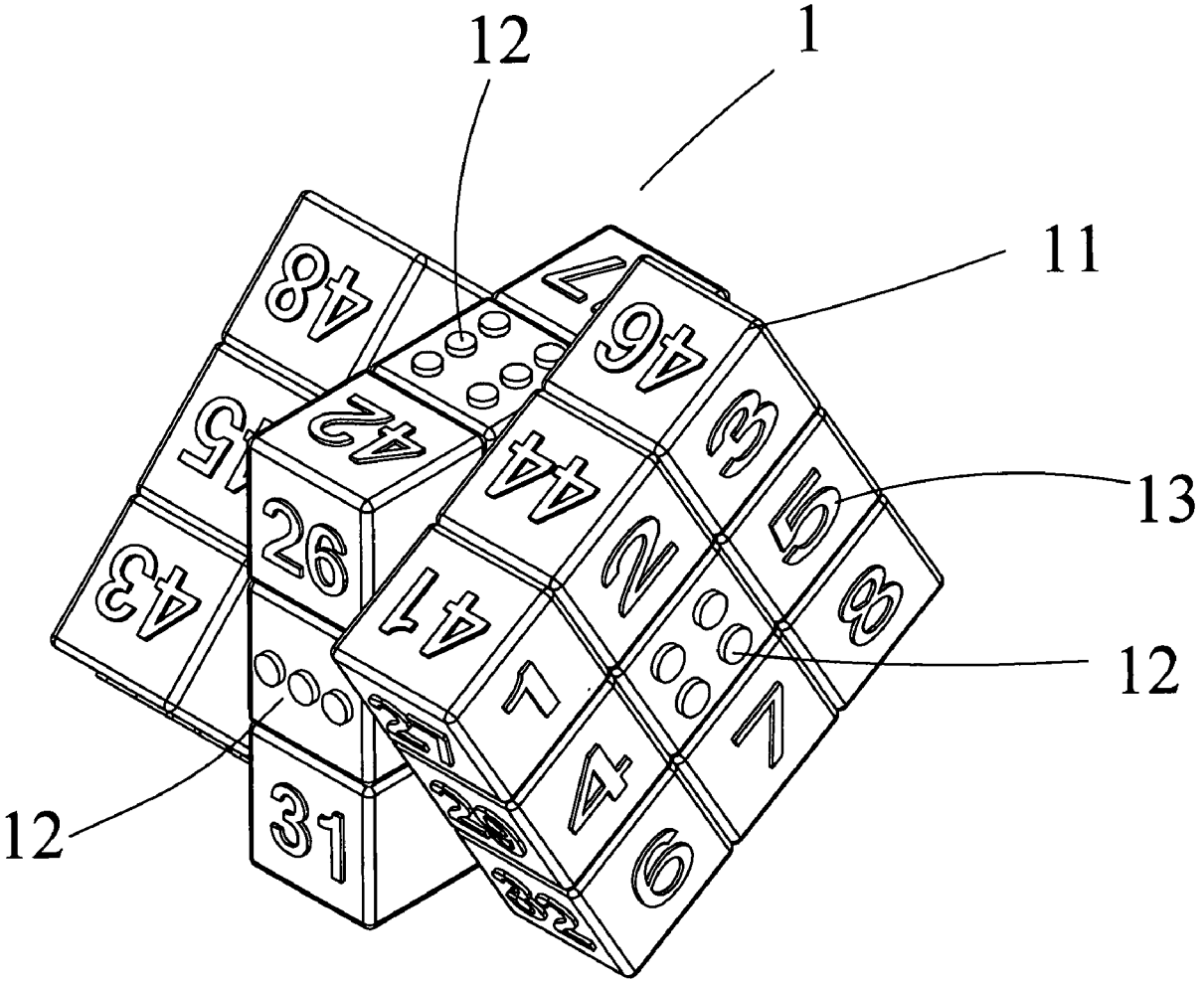
FIG. 2 is a schematic operational view of the magic cube as shown in FIG. 1.
Figure 3:
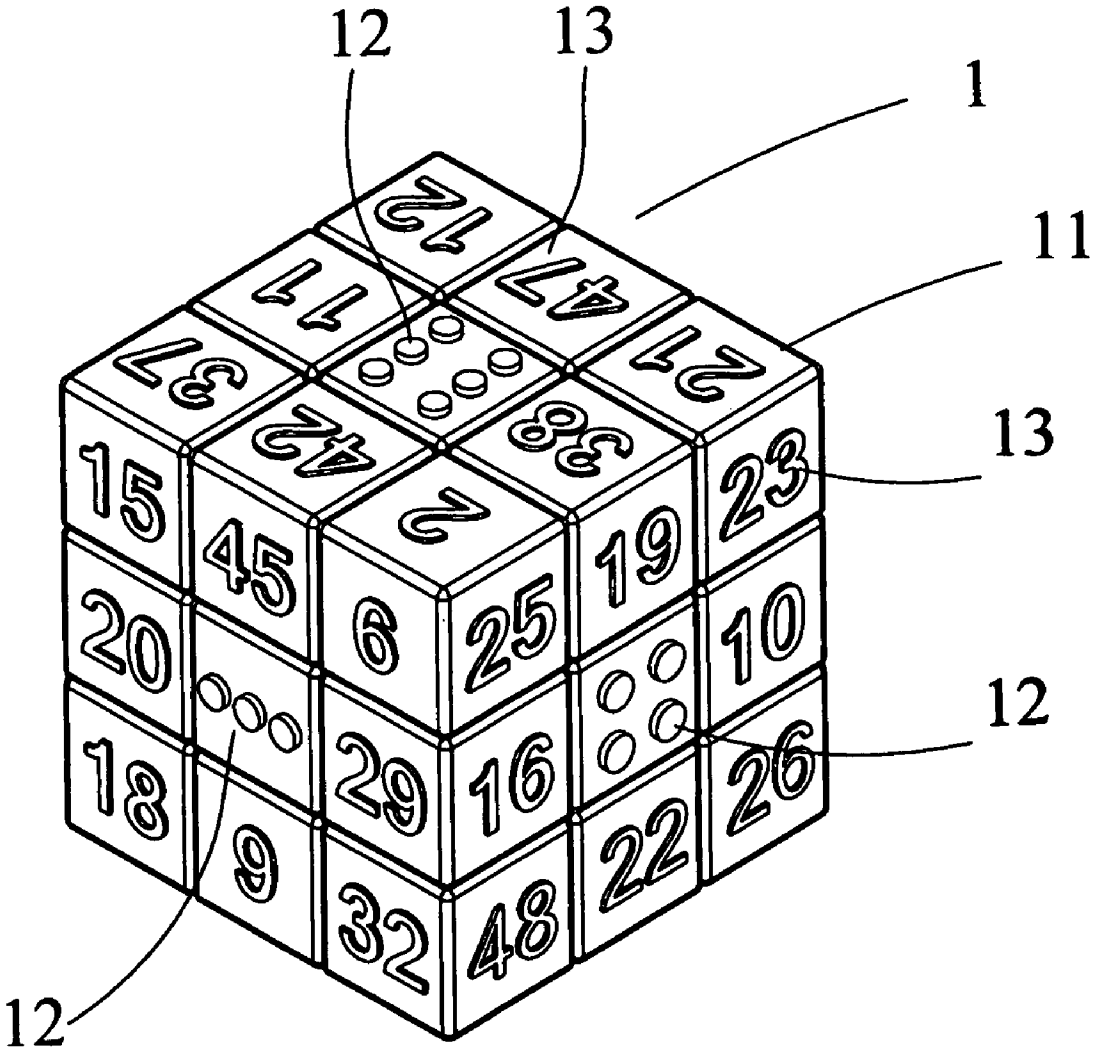
FIG. 3 is another perspective view of the magic cube in accordance with the preferred embodiment of the present invention.
Figure 4:
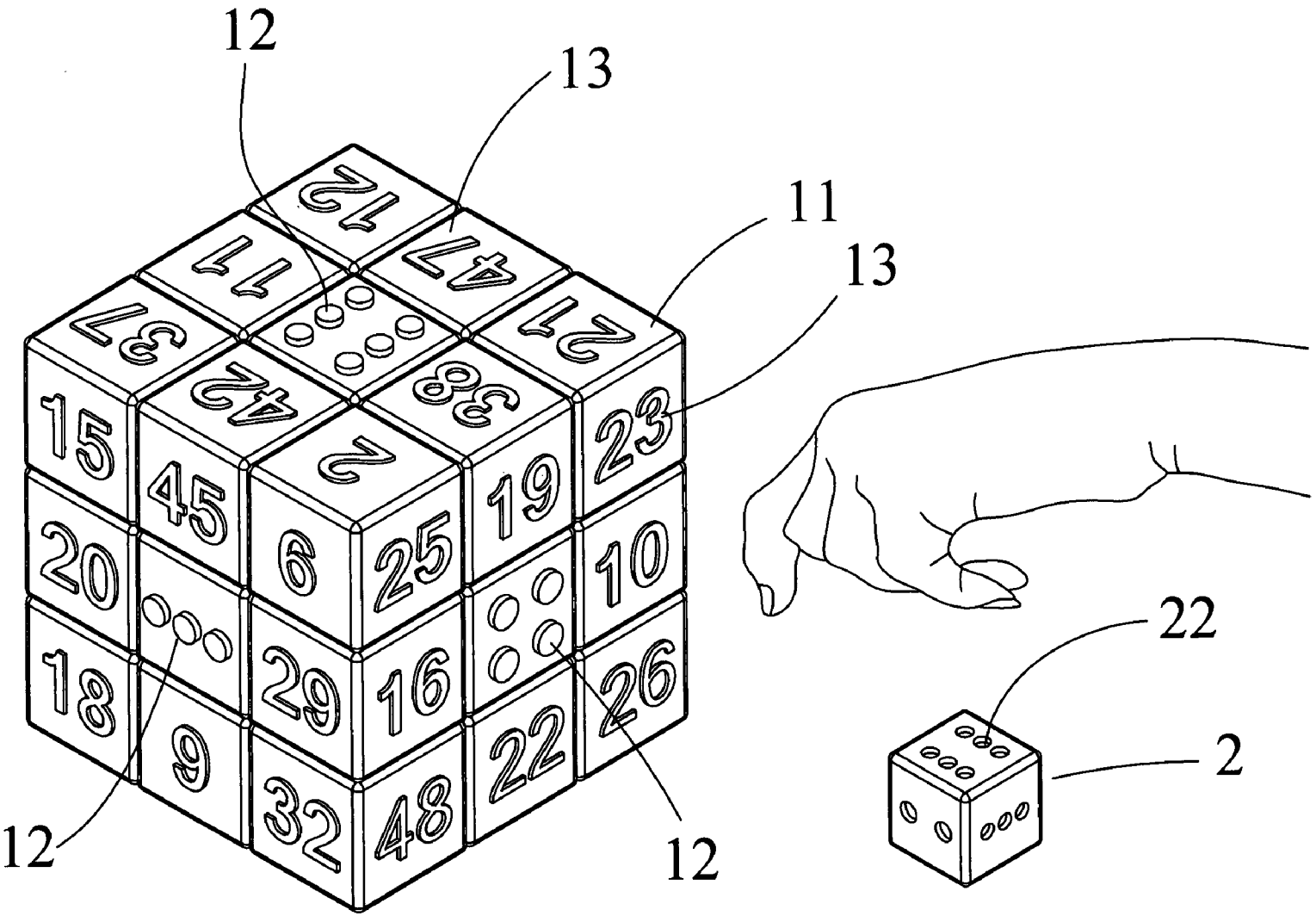
FIG. 4 is a schematic operational view of the magic cube as shown in FIG. 3.
Figure 5:
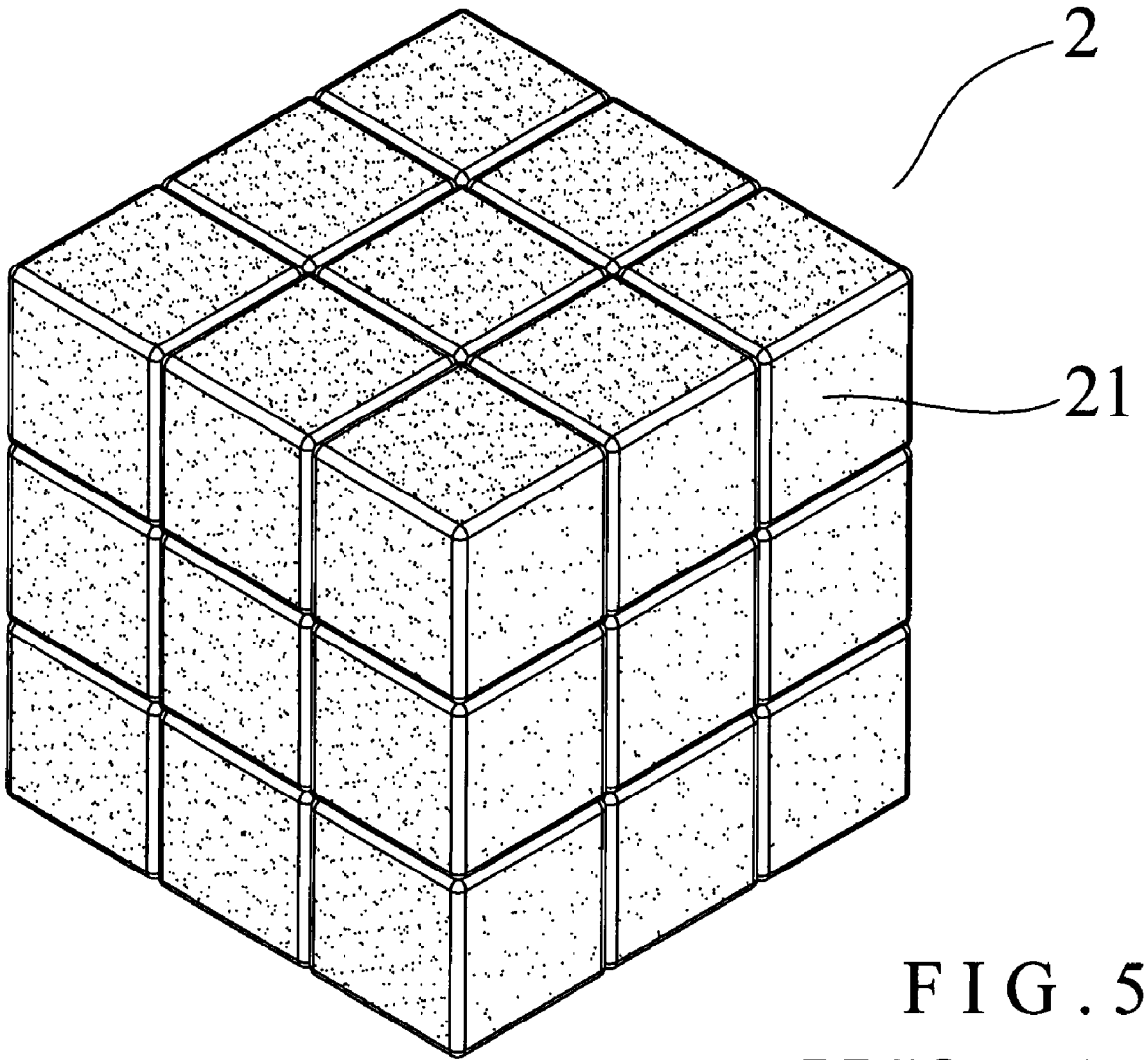
FIG. 5 PRIOR ART
FIG. 5 is a perspective view of a conventional magic cube in accordance with the prior art.

When in use, referring to FIGS. 1–4, the relatively larger cubic block 1 containing six circular pointed markings (from 1 to 6 point) 12 and forty-eight Arabic numerals (from number 1 to 48) 13 is rotated longitudinally and transversely in a random manner as shown in FIG. 2 to change the relative position between the relatively smaller cubic blocks 11, so that all of the Arabic numerals 13 of the relatively larger cubic block 1 are arranged in an irregular manner as shown in FIG. 3. At this time, all of the six circular pointed markings 12 of the relatively larger cubic block 1 are located at the central position of each of the six relatively larger faces. Then, the players can throw a dice 2 which has six circular pointed markings 22 to correspond to the six circular pointed markings 12 of the relatively larger cubic block 1. For example, when the circular pointed marking 22 of the dice 2 shows the six point as shown in FIG. 4, the circular pointed marking 12 of the relatively larger cubic block 1 corresponding to the circular pointed marking 22 of the dice 2 is six point, so that all of the Arabic numerals 13 (2, 42, 37, 38, 11, 21, 47 and 12) located at the same face of the circular pointed marking (the six point) 12 are calculated to obtain a total number. Thus, the player who gets the maximum total number is the winner.

Accordingly, the relatively larger cubic block 1 of the magic cube has six circular pointed markings 12 corresponding to the six circular pointed markings 22 of the dice 2 and has forty-eight Arabic numerals 13 matching the respective circular pointed markings 12, so that the players can calculate all of the Arabic numerals 13 located at the same face of the circular pointed marking 12 to determine the winner, thereby enhancing the amusement effect of the magic cube. In addition, the playing regulation of the magic cube is designed by a computer program and executed by the on-line computer internet, so that the players can play the game of the magic cube instantly, thereby providing an interesting effect to the on-line players.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A magic cube, comprising a relatively larger cubic block formed by a plurality of relatively smaller cubic blocks to form a cubic body, wherein:

the relatively larger cubic block has six relatively larger faces each having nine relatively smaller faces;

a central one of the nine relatively smaller faces of the six relatively larger faces is indicated by a circular pointed marking ranged from 1 (one) to 6 (six) point;

the other ones of the nine relatively smaller faces of the six relatively larger faces is indicated by an Arabic numeral ranged from 1 (one) to 48 (forty-eight).

2. The magic cube in accordance with claim 1, wherein the relatively larger cubic block can be rotated longitudinally and transversely in a random manner to change a relative position between the relatively smaller cubic blocks.

3. The magic cube in accordance with claim 2, wherein all of the Arabic numerals of the relatively larger cubic block are arranged in an irregular manner.

4. The magic cube in accordance with claim 2, wherein all of the circular pointed markings of the relatively larger cubic block are located at the central position of each of the six relatively larger faces.

5. The magic cube in accordance with claim 1, wherein the relatively larger cubic block of the magic cube has six circular pointed markings corresponding to the six circular pointed markings of the dice and has forty-eight Arabic numerals matching the respective circular pointed markings, so that all of the Arabic numerals located at the same face of the circular pointed marking can be calculated to obtain a total number.

6. The magic cube in accordance with claim 1, wherein the playing regulation of the magic cube is designed by a computer program and executed by an on-line computer internet.

* * * * *